US005822651A

United States Patent [19]

Yim et al.

[11] Patent Number: 5,822,651

[45] Date of Patent: Oct. 13, 1998

[54] TRANSFER VOLTAGE ADJUSTING DEVICE

[75] Inventors: Gwang-Pyo Yim; Chang Kyung Ko, both of Suwon, Rep. of Korea

[73] Assignee: SamSung Electronics Co., Ltd., Kyungki-do, Rep. of Korea

[21] Appl. No.: 827,153

[22] Filed: Mar. 27, 1997

[30] Foreign Application Priority Data

Mar. 28, 1996 [KR] Rep. of Korea ..... 1996-8887

[51] Int. Cl.[6] ..... G03G 15/16

[52] U.S. Cl. ..... 399/66; 399/44; 399/45; 399/314

[58] Field of Search ..... 399/44, 45, 66, 399/97, 313, 314; 361/230, 225, 235

[56] References Cited

U.S. PATENT DOCUMENTS

| | | | |
|---|---|---|---|
| 3,837,741 | 9/1974 | Spencer . | |
| 4,401,383 | 8/1983 | Suzuki et al. . | |
| 5,119,141 | 6/1992 | Bhagat | 399/44 |
| 5,144,368 | 9/1992 | Ohzeki et al. . | |
| 5,151,736 | 9/1992 | Ohzeki et al. . | |
| 5,321,476 | 6/1994 | Gross . | |
| 5,438,399 | 8/1995 | Asai . | |
| 5,450,180 | 9/1995 | Ohzeki et al. . | |
| 5,455,664 | 10/1995 | Ito et al. . | |
| 5,493,371 | 2/1996 | Kutsuwada et al. . | |
| 5,504,565 | 4/1996 | Tomiki et al. . | |
| 5,633,703 | 5/1997 | Takenouchi et al. | 399/66 X |
| 5,682,575 | 10/1997 | Komori | 399/66 |
| 5,697,015 | 12/1997 | Ream et al. | 399/66 |

FOREIGN PATENT DOCUMENTS

| | | |
|---|---|---|
| 6-019334 | 1/1994 | Japan . |
| 6-043767 | 2/1994 | Japan . |
| 6-208307 | 7/1994 | Japan . |
| 7-104586 | 4/1995 | Japan . |
| 7-209928 | 8/1995 | Japan . |
| 8-248786 | 9/1996 | Japan . |
| 9-080936 | 3/1997 | Japan . |

*Primary Examiner*—Matthew S. Smith
*Attorney, Agent, or Firm*—Robert E. Bushnell, Esq.

[57] ABSTRACT

A transfer voltage adjusting apparatus senses the thickness of printing papers used as recording medium and the printing environment and outputs transfer voltage according to the sensed thickness and the printing environment, thereby achieving an optimum image density. The transfer voltage adjusting device for an electrophotographic developing system, having a voltage generator for generating and outputting a transfer voltage and a register voltage to a transfer roller and a register roller depending on a voltage generating signal; a first current-voltage converter for detecting a current level inputted to the transfer roller by the level of the transfer voltage outputted from the voltage generator, converting the current level into a voltage level and outputting the converted voltage level; a second current-voltage converter for detecting the current level inputted to the register roller by the level of the register voltage outputted from the voltage generator, converting the detected current level into the voltage level and outputting the converted voltage level; a controller for controlling an overall operation and outputting the voltage generating signal for adjusting the level of the transfer voltage according to the voltage level inputted from the first and second current-voltage converters to the voltage generator.

15 Claims, 3 Drawing Sheets

TRANSFER VOLTAGE ADJUSTING DEVICE

CLAIM OF PRIORITY

This application makes claims all benefits accruing under 35 U.S.C. §119 from an application for TRANSFER VOLTAGE ADJUSTING DEVICE earlier filed in the Korean Industrial Property Office on 28 Mar. 1996 and there duly assigned Ser. No. 8887/1996.

BACKGROUND OF THE INVENTION

1. Field of the Invention

The present invention relates to an image forming apparatus comprising an electrophotographic developing system and, more particularly, to a transfer voltage adjusting device for supplying an optimum transfer voltage by sensing the printing environment and the thickness of the printing paper.

2. Description of the Related Art

In general, copying machines, laser beam printers and plain paper facsimile machines are exemplary of image forming apparatuses that print a given image on a recording medium by using an electrophotographic developing system. Generally, the image forming apparatuses are set with optimum developing process conditions capable of obtaining optimal image density in a normal temperature and humidity. However, if there is a striking difference between the printing environment and the condition of the normal temperature and humidity set for the optimum developing process, that is, there is a printing environment such as low temperature and low humidity or high temperature and high humidity, there has been a problem in that an image quality may be deteriorated due to variations of the resistance of a transfer roller as one unit of the image forming apparatuses. In order to solve the problem as the above, the image forming apparatuses using an earlier electrophotographic developing system have a construction as noted below.

In an earlier transfer voltage adjusting apparatus for adjusting a transfer voltage by sensing environmental changes, a voltage generator generates a transfer voltage in response to a pulse width modulation signal inputted from a microprocessor, outputting the generator transfer voltage to a transfer roller and photosensitive drum. A current to voltage converter detects the current caused by the impedance of the transfer roller and photosensitive drum and converts the detected current into a voltage and outputs the converted voltage. The impedance of the transfer roller and photosensitive drum includes an air impedance due to a gap between a transfer roller and a photosensitive drum. The microprocessor, having an analog to digital converter and a memory, generates the pulse width modulated signal in response to the voltage inputted from the current to voltage converter, thereby adjusting the level of the transfer voltage.

An equivalent impedance of the transfer roller and photosensitive drum includes all impedance values covering the photosensitive drum impedance, the transfer roller impedance, and an air impedance generated by the gap between the photosensitive drum and the transfer roller. These impedances, which are connected in series, depend on the peripheral environmental factors such as temperature, humidity, etc. A current detection resistor, used as an embodiment of the current to voltage converter, is connected between the voltage generator and ground and a junction point between the voltage generator and the current detection resistors connected to the microprocessor. The operation of the earlier transfer voltage adjusting device having the above-noted construction is as follows.

Firstly, when a printing command is received from an external unit, such as a host computer, the microprocessor generates the pulse width modulated signal in accordance with the developing process condition under the normal temperature and humidity and outputs the pulse width modulated signal to the voltage generator. The voltage generator generates the given transfer voltage in response to the inputted pulse width modulation signal and supplies the generated transfer voltage to the equivalent impedance of the transfer roller and photosensitive drum. If the temperature and humidity around the transfer roller and photosensitive drum are high, the resistance of the equivalent impedance is reduced so that a detection voltage being fed back to the microprocessor has a lower level than that of the detection voltage under the normal temperature and humidity. Thereafter, the microprocessor senses an environmental change through the detection voltage and accordingly generates the pulse width modulated signal, thereby adjusting the transfer voltage. However, in the earlier image forming apparatus having the transfer voltage adjusting apparatus as noted above, since an environmental factor is sensed and the transfer voltage is set before the printing papers are provided between the photosensitive drum and the transfer roller, it results in a problem of degradation of the image quality according to the printing papers. For example, when printing papers having a high resistance value are used as the recording medium, the equivalent impedance of the transfer roller and photosensitive drum is varied according to the printing papers so as to decrease the transfer efficiency.

The Ohzeki et al. patents, U.S. Pat. Nos. 5,151,736 and 5,144,368, respectively entitled Image Forming Apparatus With Controlled Transfer Voltage, and Charging Device And Image Forming Apparatus Having Same, each disclose image forming apparatus in which the charging current or transfer voltage is controlled in accordance with the ambient conditions.

The Suzuki et al. patent, U.S. Pat. No. 4,401,383 entitled Transfer Device For Use In Retention Type Electrophotographic Copying Machine, discloses a transfer device for an electrophotographic copier in which the transfer voltage is varied in accordance with changes in the recording paper characteristics due to changes in ambient conditions.

Similarly, the Spencer patent, U.S. Pat. No. 3,837,741, entitled Control Arrangement For Transfer Roll Power Supply discloses a control arrangement for a transfer roll power supply which the voltage is varied in accordance with the characteristics of the recording paper which in turn vary in accordance with the changes in ambient conditions.

The following additional patents each disclose features in common with the present invention but are not as pertinent as the patents discussed above in detail:

U.S. Pat. No. 5,321,476 to Gross, entitled Heated Bias Transfer Roll, U.S. Pat. No. 5,438,399 to Asai, entitled Image Forming Apparatus Having Transfer Voltage Control, U.S. Pat. No. 5,493,371 to Kutsuwada et al., entitled Image Transferring Device For Image Forming Apparatus, U.S. Pat. No. 5,504,565 to Tomiki et al., entitled Image Forming Apparatus Having Transfer Voltage Timing Control, U.S. Pat. No. 5,455,664 to Ito et al., entitled Electrophotographic Printer For Transferring Images On different Sized Print Medium And Transferring Method Of The Same, and U.S. Pat. No. 5,450,180 to Ohzeki et al., entitled Image Forming Apparatus Having Constant Current And Voltage Control In The Charging And Transfer Regions.

SUMMARY OF THE INVENTION

Therefore, it is an object of the present to provide a transfer voltage adjusting apparatus for sensing both the thickness of printing papers used as the recording medium and the printing environment and for outputting a transfer voltage according to the sensed thickness and the printing environment, thereby achieving an optimum image density.

To accomplish the above object, the present invention provides a transfer voltage adjusting is device using an electrophotographic developing system, having a voltage generator for generating and outputting a transfer voltage and a register voltage to a transfer roller and a register roller depending on a voltage generating signal; a first current-voltage converter for detecting a current level inputted to the transfer roller by the level of the transfer voltage outputted from the voltage generator, converting the current level into a voltage level and outputting the converted voltage level; a second current-voltage converter for detecting the current level inputted to the register roller by the level of the register voltage outputted from the voltage generator, converting the detected current level into a voltage level and outputting the converted voltage level; and a controller for controlling an overall operation and outputting the voltage generating signal for adjusting the level of the transfer voltage according to the voltage level inputted from the first and second current-voltage converters to the voltage generator.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
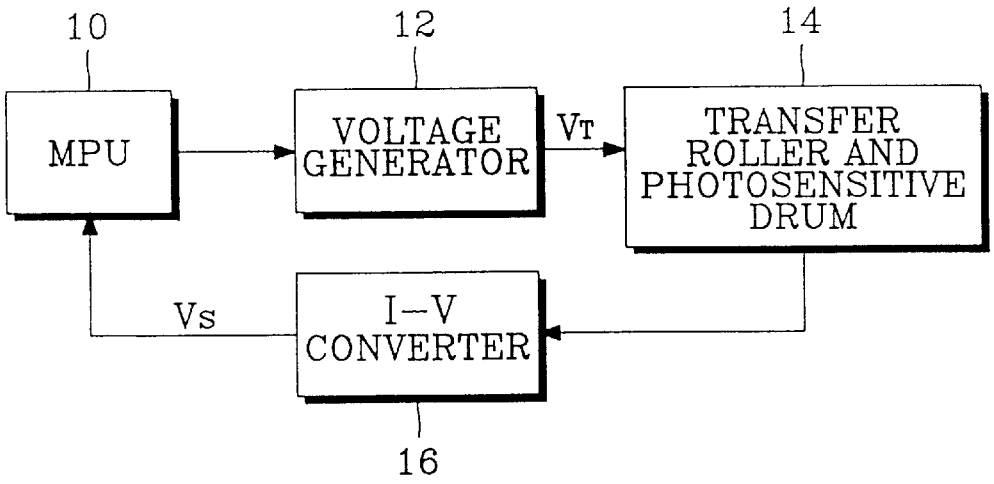
FIG. 1 is a block diagram illustrating construction of an earlier transfer voltage adjusting device for adjusting a transfer voltage by sensing environmental change.

Hereinafter, a preferred embodiment of the present invention will be described in detail with reference to the accompanying drawing. Throughout the drawings, it is noted that the same reference numerals or letters will be used to designate like or equivalent elements having the same function. Further, in the following description, numeral specific details such as concrete components composing the circuit, are set forth to provide a more thorough understanding of the present invention. It will be apparent, however, to one skilled in the art that the present invention may be practiced without these specific details. A detailed description of known functions and constructions unnecessarily obscuring the subject matter of the present invention have been omitted in the following description.

FIG. 1 is a block diagram illustrating construction of an earlier transfer voltage adjusting apparatus for adjusting a transfer voltage by sensing environmental changes. In FIG. 1, a voltage generator 12 generates a transfer voltage (hereinafter, referred to as $V_T$) responding to a pulse width modulation (hereinafter, referred to as a PWM) signal inputted from a microprocessor unit (hereinafter, referred to as an MPU) 10, outputting the generated transfer voltage $V_T$ to a transfer roller and photosensitive drum 14. An I-V (current-voltage) converter 16 detects the current caused by the impedance of the transfer roller and photosensitive drum 14, converts the detected current into a voltage Vs, and outputs the converted voltage Vs. The impedance of the transfer roller and photosensitive drum 14 includes an air impedance Zair due to a gap between a transfer roller and a photosensitive drum. The MPU 10 having an analog-to-digital (hereinafter, referred to as an A/D) converter and a memory, generates the PWM signal in response to the voltage Vs inputted from the I-V converter 16, thereby adjusting the level of the transfer voltage $V_T$. Hereinafter, referring to FIG. 2 in which an equivalent impedance of the transfer roller and photosensitive drum 14 is embodied, problems in the earlier image forming apparatus for adjusting the level of the transfer voltage according to variations of the environment will be explained.

Figure 2:
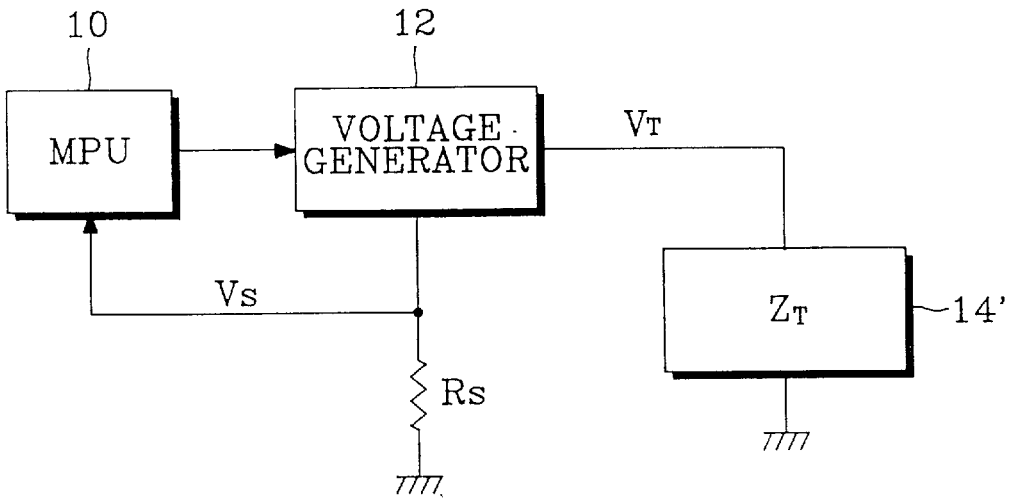
FIG. 2 is a detailed circuit diagram illustrating one part of an earlier transfer voltage adjusting device for explanation of steps of adjusting the transfer voltage.

FIG. 2 is a detailed circuit diagram illustrating one part of an earlier transfer voltage adjusting device for explaining the steps of adjusting the transfer voltage. In FIG. 2 an equivalent impedance $Z_T$ 14' of the transfer roller and photosensitive drum 14 includes all impedance values covering the photosensitive drum impedance Zopc, the transfer roller impedance $Z_T$, and an air impedance Zair generated by the gap between the photosensitive drum and the transfer roller. That is, the value $Z_T$ 14' is produced by connecting the photosensitive drum impedance Zopc, the transfer roller impedance $Z_T$, and the air impedance Zair in series. These impedances vary depending on the peripheral environmental factors such as temperature, humidity and so on. A current detection resistor $R_S$, used as an embodiment of I-V converter 16 in FIG. 1, is connected between the voltage generator 12 and ground, and a junction point between the voltage generator 12 and the current detection resistor $R_S$ is connected to the MPU 10. The operation of the earlier transfer voltage adjusting device having the above-noted construction is as follows. Firstly, when a printing command is received from an external unit such as a host computer, the MPU 10 generates the PWM signal in accordance with the developing process condition under the normal temperature and humidity to and outputs the PWM signal to the voltage generator 12. The voltage generator 12 generates the given transfer voltage $V_T$ in response to the inputted PWM signal and supplies the generated transfer voltage $V_T$ to the equivalent impedance $Z_T$ 14' of the transfer roller and photosensitive drum 14. If the temperature and humidity around the transfer roller and photosensitive drum 14 are high, the resistance of the equivalent impedance $Z_T$ 14' is reduced, so that a detection voltage Vs being fed back to the MPU 10 has a lower level than that of the detection voltage Vs under the normal temperature and humidity. Thereafter, the MPU 10 senses an environmental change through the detection voltage Vs and accordingly generates the PWM signal, thereby adjusting the transfer voltage $V_T$. However, in the earlier image forming apparatus having the transfer voltage adjusting apparatus as mentioned above, since an environmental factor is sensed and the transfer voltage is set before the printing papers are provided between the photosensitive drum and the transfer roller, it results in a problem of degradation of the image quality according to the printing papers. For example, when printing papers having a high resistance value are used as the recording medium, the equivalent impedance $Z_T$ 14' of the transfer roller and photosensitive drum 14 is varied according to the printing papers, so as to decrease the transfer efficiency.

Figure 3:
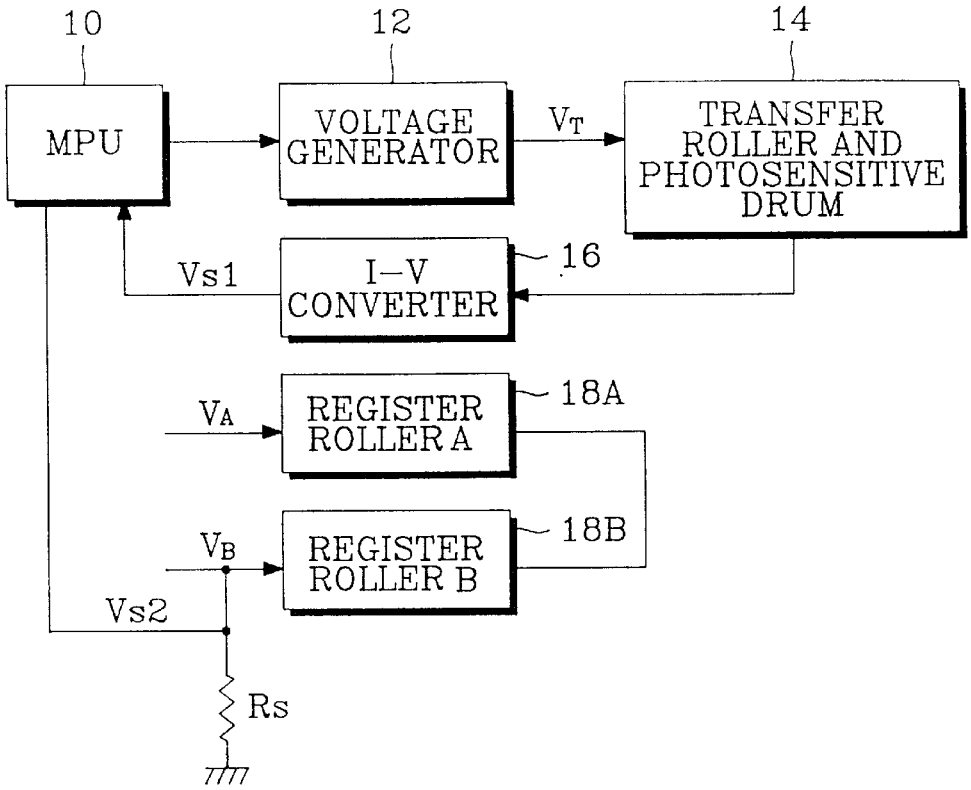
FIG. 3 is a block diagram illustrating the construction of a transfer voltage adjusting device according to an embodiment of the present invention.
Figure 4:
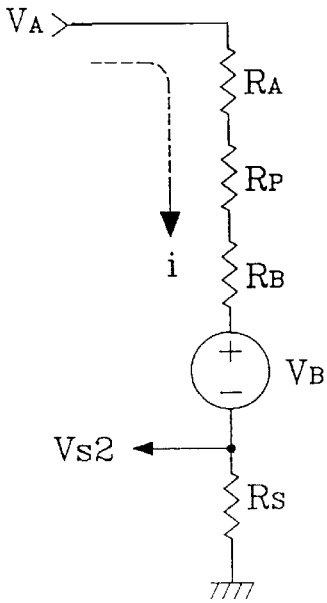
FIG. 4 is a diagram illustrating an equivalent circuit composed of register rollers 18A and 18B of FIG. 3, a resistor of printing papers conveyed between the above register rollers and a current detection resistor $R_S$.

FIG. 3 is a block diagram illustrating the construction of a transfer voltage adjusting device according to an embodiment of the present invention. Referring to FIG. 3, the construction of the transfer voltage adjusting device such as the MPU 10, the voltage generator 12, the transfer roller and photosensitive drum 14 and the current-voltage converter 16 is the same as that of the earlier transfer voltage adjusting device. That is, the transfer voltage adjusting device according to the present invention having the same construction as the earlier transfer voltage adjusting device, senses the printing environment around the transfer roller and photosensitive drum 14 to thereby use the sensed printing environment in adjusting the transfer voltage. In the transfer voltage adjusting device according to present invention, voltages $V_A$ and $V_B$ of respective given levels are respectively supplied to register rollers 18A and 18B as shown in FIG. 3 so that the thickness of the printing papers used as the recording medium can be sensed and the sensed thickness of the printing papers can be used in adjusting the transfer voltage. The register rollers 18A and 18B arrange the printing papers conveyed by a pick-up roller, which are generally positioned between the transfer roller and the pickup roller. Hereinafter, the voltages $V_A$ and $V_B$ supplied to the register rollers 18A and 18B are called the register voltages, which are outputted from the voltage generator 12 under the control of the MPU 10. The current detection resistor $R_S$ is connected between a voltage input terminal and ground, and the junction point therebetween is connected to the MPU 10. That is, the voltage level value $V_S$2 across the terminals of the current detection resistor $R_S$ used as the I-V converter is inputted to the MPU 10, thereby sensing the thickness of the printing papers. Referring to FIG. 4, in the case that the printing papers are passed between the register rollers 18A and 18B of FIG. 3, the variation of the voltage level value across the terminals of the current detection resistor $R_S$ will be explained hereinafter.

FIG. 4 is a diagram illustrating an equivalent circuit composed of register rollers 18A and 18B of FIG. 3, a resistor of printing papers conveyed between the above register rollers, and a current detection resistor $R_S$. In FIG. 4, the resistors $R_A$ and $R_B$ respectively denote the resistors of each of the register rollers 18A and 18B, and $R_P$ and $R_S$ respectively denote the resistance and the current detection resistor of the printing papers. The register voltages $V_A$ and $V_B$ are supplied under the control of the MPU 10, and the MPU 10 senses conveyance of the printing papers between the register rollers 18A and 18B through a sensor for sensing the printing papers, the sensor being positioned at a front end of the register rollers 18A and 18B. If a sheet of printing papers from a paper cassette is conveyed between the register rollers 18A and 18B, the amount of the current being inputted into the register rollers 18A and 18B and the current detection resistor $R_S$ by the register voltages $V_A$ and $V_B$ may be calculated as $[(V_A-V_B)/(R_A+R_P+R_B+R_S)]$. That is, when the printing paper being conveyed has a high resistance value, if the amount of the current is indicated as Ia, the level of voltage $V_S$2 across the terminals of the current detection resistor $R_S$ may be calculated as $R_S \times Ia$. On the other hand, in the case that the printing papers under conveyance has a low resistor value, if the amount of the current is indicated as Ib, the level of the voltage $V_S$2 may be calculated as $R_S \times Ib$. As a result, the current detection voltage $V_S$2 inputted into the MPU 10 is frequently varied according to the resistance value of the printing papers. For this reason, the MPU 10 senses variation of the printing environment around the transfer roller and photosensitive drum 14 as well as supplying the register voltages $V_A$ and $V_B$ to the register rollers 18A and 18B, simultaneously, so that the thickness of the printing papers can be sensed through the inputted current detection voltage $V_S$2. In the meantime, the MPU 10 converts the current detection voltages $V_S$1 and $V_S$2 into digital data through the A/ID converter and then outputs the voltage generating signal based on following

TABLE 1

| Printing environment | transfer voltage | resistance value of printing paper |
|---|---|---|
| high temperature/ high humidity | $V_T$ + A1 | low resistance value |
| | $V_T$ + A2 | general printing paper |
| | $V_T$ + A3 | high resistance value |
| normal temperature/ normal humidity | $V_T$ + A4 | low resistance value |
| | $V_T$ + A5 | general printing paper |
| | $V_T$ + A6 | high resistance value |
| low temperature/ low humidity | $V_T$ + A7 | low resistance value |
| | $V_T$ + A8 | general printing paper |
| | $V_T$ + A9 | high resistance value |

Referring to the above <Table 1>, on the basis of general printing papers, transfer voltages of different levels are outputted according to the printing papers having a high resistance value and a low resistance value under the respective printing environments. $V_T$+A1, $V_T$+A2, and $V_T$+A3 in the above are the outputted transfer voltages having values indicative of a low pager resistance, the general printing paper and a high resistance on the basis of the general printing papers under the high temperature/high humidity condition. For example, when the current detection voltage $V_S$1 for sensing the printing environment indicates the high temperature/high humidity condition and the current detection voltage $V_S$2 for sensing the thickness of the printing papers indicates a low resistance value, the MPU 10 generates a voltage generating signal for outputting the transfer voltage equal to $V_T$+A1 on the basis of the above <Table 1>. As a result, since a final transfer voltage in which the printing environment and the thickness of the printing papers together are compensated for is supplied to the transfer roller, optimum toner is transferred to the printing papers, so that a good image quality of printing can be attained.

Figure 5:
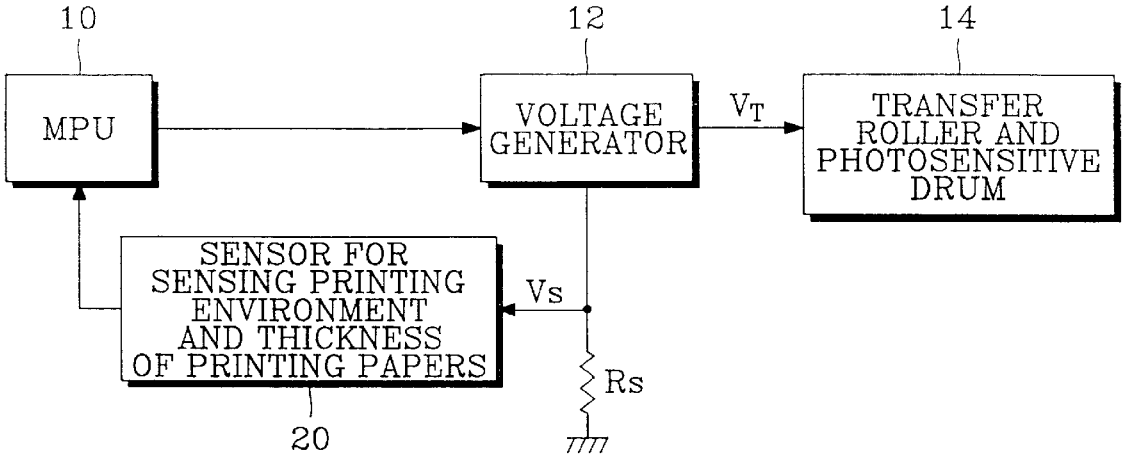
FIG. 5 is a block diagram illustrating construction of the transfer voltage adjusting device according to another embodiment of the present invention.
Figure 6:
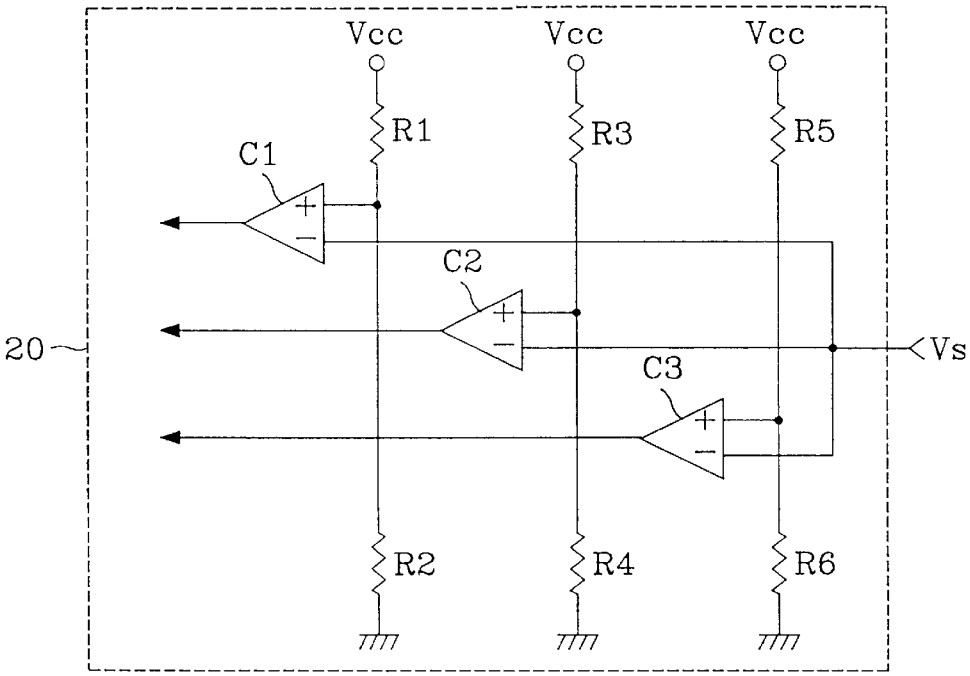
FIG. 6 is a detailed circuit illustrating a sensor 20 for sensing a printing environment and the thickness of the printing papers.

FIG. 5 is a block diagram illustrating construction of the transfer voltage adjusting device according to another embodiment of the present invention. FIG. 6 is a detailed circuit illustrating a sensor 20 for sensing a printing environment and the thickness of the printing papers. In FIG. 5, the construction of the transfer voltage adjusting device is the same as that of FIG. 3. The sensor 20 for sensing the printing environment and the thickness of the papers is connected between the MPU 10 and one portion of the current detection resistor $R_S$. The above sensor 20 compares the current detection voltage Vs across the terminals of the current detection resistor $R_S$ with reference voltage level values that are differently set according to the printing environment and the thickness of the printing papers, thereby outputting the generated logic level values to the MPU 10. Hereinafter, referring to FIG. 6, an operation of the sensor for sensing the printing environment and the thickness of the printing papers will be explained in detail.

Firstly, the sensor 20 for sensing the printing environment and the thickness of the printing paper consists of three comparators C1, C2, C3 and resistors R1 to R6 for dividing the power supply voltage Vcc and supplying the divided voltage Vcc to respective non-inverting input terminals of the above-noted comparators. The inverting input terminals of respective comparators C1 to C3 are connected to the junction point of the voltage generator 12 and the current detection resistor $R_S$, where the current detection voltage Vs varies due to the printing environment and the thickness of the printing paper. Hereinafter, in the case that the printing papers are conveyed between the transfer roller and photosensitive drum 14, an operation of the comparators C1 to C3 will be as follows. When the MPU 10 outputs the voltage generating signal for generating the transfer voltage $V_T$ of a given level to the voltage generator 12 in response to a printing command received from the host computer, the voltage generator 12 outputs the transfer voltage $V_T$ of a given level. Thereafter, when the printing papers picked from the paper cassette are passed between the transfer roller and photosensitive drum 14, the current detection voltage Vs across the terminals of the current detection resistor $R_S$ is detected in the same manner as depicted in FIG. 2. At this time, the comparators compare the level value of the power supply voltage Vcc divided by the resistor values R1 to R6 that are differently set with one another, with the current detection voltage Vs, thereby accordingly generating and outputting respective logic level values to the MPU 10 in order to sense the printing environment and the thickness of the printing papers. Thereafter, the MPU 10 outputs the voltage generating signal in response to the logic level values inputted from output terminals of the comparators C1 to C3 to thereby set a final transfer voltage in conformity with the printing environment and the thickness of the printing papers. Accordingly, the amount of toner transferred to the printing papers from the photosensitive drum is increased, thereby obtaining the optimum image quality.

The transfer voltage adjusting device according to the present invention as explained above, has a advantage in that, when printing an image according to image data received from an external unit such as a host computer, the transfer voltage according to variations of the resistance value caused due to the variation of the temperature and the humidity and the variation depending on the thickness of the printing papers is compensated for, so as to achieve the optimum image quality.

What is claimed is:

1. A transfer voltage adjusting device for an electrophotographic developing system, comprising:

a voltage generator for generating and outputting a transfer voltage and a register voltage to a transfer roller and a register roller pair depending on a voltage generating signal;

a first current-voltage converter for detecting a current level inputted to said transfer roller by the level of said transfer voltage outputted from said voltage generator, converting said detected current level into a voltage level and outputting said converted voltage level to a controller;

a second current-voltage converter for detecting a current level inputted to said register roller by the level of said register voltage outputted from said voltage generator, converting said detected current level into a voltage level and outputting said converted voltage level to said controller; and said controller for controlling an overall operation of the system and for outputting said voltage generating signal to said voltage generator, the transfer voltage level being adjusted according to said converted voltage levels inputted from said first and second current-voltage converters.

2. The device as claimed in claim 1, wherein said controller outputs said voltage generating signal for generating said register voltages when a recording medium is provided between said roller pair.

3. The device as claimed in claim 2, wherein said controller comprises a table in which transfer voltage adjusting values corresponding to voltage level values inputted from said first and second current-voltage converters is stored.

4. The device as claimed in claim 2, wherein said controller comprises a table in which transfer voltage adjusting values corresponding to voltage level values inputted from said first and second current-voltage converters is stored.

5. A transfer voltage adjusting device for an electrophotographic developing system, comprising:

a voltage generator for generating and outputting a transfer voltage according to a voltage generating signal;

a current-voltage converter for detecting a current level inputted to a transfer roller by the level of said transfer voltage outputted from said voltage generator, converting said detected current level into a voltage level and outputting said converted voltage level;

a sensor for sensing the thickness of printing paper by comparing voltage values of a given level inputted from said current-voltage converter with those of reference voltages that are differently set from one another, and accordingly generating and outputting logic level values in response thereto; and a controller for executing an overall control operation of the system and for outputting said voltage generating signal according to said logic level values inputted from said sensor.

6. The device as claimed in claim 5, said controller comprising a table for generating different transfer voltage levels that are set to be different from each other according to a printing environment such as high temperature/high humidity, normal temperature/normal humidity, and low temperature/low humidity.

7. The device as claimed in claim 6, said sensor comprising three comparators having reference voltage level values that are differently set from each other supplied to non-inverting input terminals of said comparators while having voltage values of a given level supplied to inverting input terminals of said comparators, in order to sense the printing environment including high temperature/high humidity, normal temperature/normal humidity, and low temperature/low humidity.

8. The device as claimed in claim 7, said controller outputting said voltage generating signal according to logic level values inputted from said sensor when the printing paper is conveyed between a photosensitive drum and said transfer roller.

9. The device as claimed in claim 8, said controller comprising a table for generating variable transfer voltage levels that are set to be different from each other according to the printing environment.

10. The device as claimed in claim 7, said controller comprising a table for generating variable transfer voltage levels that are set to be different from each other according to the printing environment.

11. The device as claimed in claim 6, said controller outputting said voltage generating signal according to logic level values inputted from said sensor when the printing paper is conveyed between a photosensitive drum and said transfer roller.

12. The device as claimed in claim 6, said controller comprising a table for generating variable transfer voltage levels that are set to be different from each other according to the printing environment.

13. The device as claimed in claim 5, said controller comprising a table for generating variable transfer voltage levels that are set to be different from each other according to the printing environment.

14. The device as claimed in claim 5, said sensor comprising three comparators having reference voltage level values that are differently set from each other supplied to non-inverting input terminals of said comparators while having voltage values of a given level supplied to inverting input terminals of said comparators, in order to sense a printing environment including high temperature/high humidity, normal temperature/normal humidity, and low temperature/low humidity.

15. The device as claimed in claim 5, said controller outputting said voltage generating signal according to logic level values inputted from said sensor when the printing paper is conveyed between a photosensitive drum and said transfer roller.

* * * * *